US010295289B2

(12) United States Patent
Geissele

(10) Patent No.: US 10,295,289 B2
(45) Date of Patent: May 21, 2019

(54) TRIGGER MECHANISM FOR A FIREARM

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 15/893,265

(22) Filed: Feb. 9, 2018

(65) Prior Publication Data

US 2018/0172380 A1 Jun. 21, 2018

Related U.S. Application Data

(60) Division of application No. 15/461,912, filed on Mar. 17, 2017, now Pat. No. 9,927,198, which is a continuation of application No. 14/723,830, filed on May 28, 2015, now Pat. No. 9,638,485, which is a continuation-in-part of application No. 29/512,565, filed on Dec. 19, 2014, now Pat. No. Des. 755,339.

(51) Int. Cl.

| | |
|---|---|
| ***F41A 19/10*** | (2006.01) |
| ***F41A 19/14*** | (2006.01) |
| ***F41A 19/12*** | (2006.01) |
| ***F41A 17/46*** | (2006.01) |
| ***F41A 19/16*** | (2006.01) |

(52) U.S. Cl.

CPC ..... *F41A 19/10* (2013.01); *F41A 17/46* (2013.01); *F41A 19/12* (2013.01); *F41A 19/14* (2013.01); *F41A 19/16* (2013.01)

(58) Field of Classification Search

CPC ..... F41A 19/10; F41A 19/16; F41A 19/45; F41A 19/14

USPC ..... 42/69.03, 69.01; 89/146, 145, 141, 132, 89/148

See application file for complete search history.

(56) References Cited

U.S. PATENT DOCUMENTS

| | | | | |
|---|---|---|---|---|
| 4,594,934 | A * | 6/1986 | Holstein | F41A 19/02 89/129.02 |
| 5,274,939 | A * | 1/1994 | Scaramucci | F41A 19/45 42/69.03 |
| D462,105 | S | 8/2002 | Myers | |
| 6,615,527 | B1 | 9/2003 | Martin | |
| 6,772,548 | B1 * | 8/2004 | Power | F41A 19/10 42/69.03 |
| D504,168 | S | 4/2005 | McCormick | |
| 7,600,338 | B2 | 10/2009 | Geissele | |
| 7,854,084 | B1 | 12/2010 | Rutherford | |
| 7,992,335 | B2 | 8/2011 | Gangl | |
| 8,069,602 | B2 * | 12/2011 | Geissele | F41A 19/16 42/69.03 |
| D659,790 | S | 5/2012 | Geissele | |
| D740,907 | S | 10/2015 | Oglesby | |
| 9,618,288 | B2 * | 4/2017 | Wilson | F41A 19/10 |
| 2008/0060245 | A1 | 3/2008 | McCormick | |
| 2011/0167696 | A1 | 7/2011 | Gangl | |
| 2014/0366418 | A1 | 12/2014 | Stakes | |
| 2016/0131449 | A1 * | 5/2016 | Horch | F41A 19/16 42/69.01 |

(Continued)

*Primary Examiner* — Reginald S Tillman, Jr.

(74) *Attorney, Agent, or Firm* — Fox Rothschild LLP

(57) ABSTRACT

A trigger mechanism for a firearm provides modified and/or adjustable trigger pull length, reduced sear pressure, reduced reset trigger slap, and/or improved engagement of the trigger safety.

18 Claims, 12 Drawing Sheets

(56) References Cited

U.S. PATENT DOCUMENTS

2016/0178303 A1 6/2016 Macy

* cited by examiner

TRIGGER MECHANISM FOR A FIREARM

CROSS-REFERENCE TO RELATED APPLICATIONS

This application is a divisional of U.S. patent application Ser. No. 15/461,912 filed Mar. 17, 2017 (now U.S. Pat. No. 9,927,198), which is a continuation of U.S. patent application Ser. No. 14/723,830 filed May 28, 2015 (now U.S. Pat. No. 9,638,485), which is a continuation-in-part of U.S. patent application Ser. No. 29/512,565 filed Dec. 19, 2014 (now U.S. Pat. No. D755,339), the disclosures of all of which are hereby incorporated by reference in their entireties.

BACKGROUND

Firearms are configured to fire rounds of ammunition. To fire a firearm, the user of the firearm can pull a trigger mechanism, which releases a hammer. The hammer is designed to then strike a firing pin which, in turn, strikes an impact sensitive round of ammunition. Once struck, the round of ammunition expels a projectile (e.g., a bullet) from the barrel of the firearm toward a target.

Some of the drawbacks of conventional firearm trigger mechanisms include a long trigger pull, "reset trigger slap," which occurs prior to a trigger reset, and an inadequate safety mechanism. A long trigger pull results in more time required to reset the trigger, which increases the time between firing projectiles and inhibits rapid fire. Reset trigger slap can be uncomfortable or painful for the shooter. Safety mechanisms can be too short to engage the trigger mechanism, resulting in the dangerous condition of the firearm firing even in safe mode.

SUMMARY

The present disclosure relates generally to an improved trigger mechanism for a firearm. In one possible configuration, and by non-limiting example, the trigger mechanism provides one or more of the following features: modified and adjustable trigger pull length, reduced sear pressure, reduced reset trigger slap, and improved engagement of the trigger safety.

In one aspect, a trigger mechanism for a firearm comprises a bow having a forward most position and rearward most position in the firearm receiver; a hammer; and a disconnector having a disconnector sear, the disconnector sear comprising a first hammer engagement edge and a recessed underside defined by a hammer engagement surface extending from the first hammer engagement edge.

In another aspect, a trigger mechanism for a firearm receiver comprises a bow having a forward most position and rearward most position in the firearm receiver; a hammer; a trigger element comprising a receiver interface, a sear arm, and a trigger sear extending from the sear arm; and a disconnector having a disconnector sear, the disconnector sear having a first hammer engagement edge; wherein the first hammer engagement edge is as high as at least a portion of the trigger sear when the bow is in the forward most position.

In a further aspect, a trigger mechanism for a firearm receiver comprises a bow having a forward most position and a rearward most position in the firearm receiver; a hammer having a trigger sear engagement surface; a trigger element comprising a receiver interface, a sear arm, and a trigger sear extending from the sear arm, the trigger sear having a hammer engagement surface and a hammer engagement edge at the rear of the hammer engagement surface; and a disconnector having a rounded forward most edge; wherein the hammer engagement surface has a width that is greater than a width of the receiver interface; and wherein the hammer engagement edge is the rearmost edge of the trigger sear when the bow is in the forward most position.

In a further aspect, a trigger mechanism for a firearm receiver comprises a bow having a forward most position and rearward most position in the firearm receiver; a hammer; a trigger element comprising a receiver interface, a sear arm, a trigger sear extending from the sear arm, and a first hammer engagement edge; and a disconnector having a disconnector sear, the disconnector sear having a second hammer engagement edge; wherein a shortest vertical distance between the first hammer engagement edge and the second hammer engagement edge does not exceed 3 mm.

In yet a further aspect, a trigger mechanism for a firearm receiver having a safe mode and a normal mode comprises a sear arm; a trigger sear extending from the sear arm; a safety mechanism comprising a pivoting lever; and a trigger element, the trigger element comprising a first wall and a second wall, the sear arm extending from the first wall, the second wall comprising an upwards protruding portion; wherein the upwards protruding portion is configured to engage the pivoting lever when the trigger mechanism is in the safe mode.

DETAILED DESCRIPTION

Figure 1:
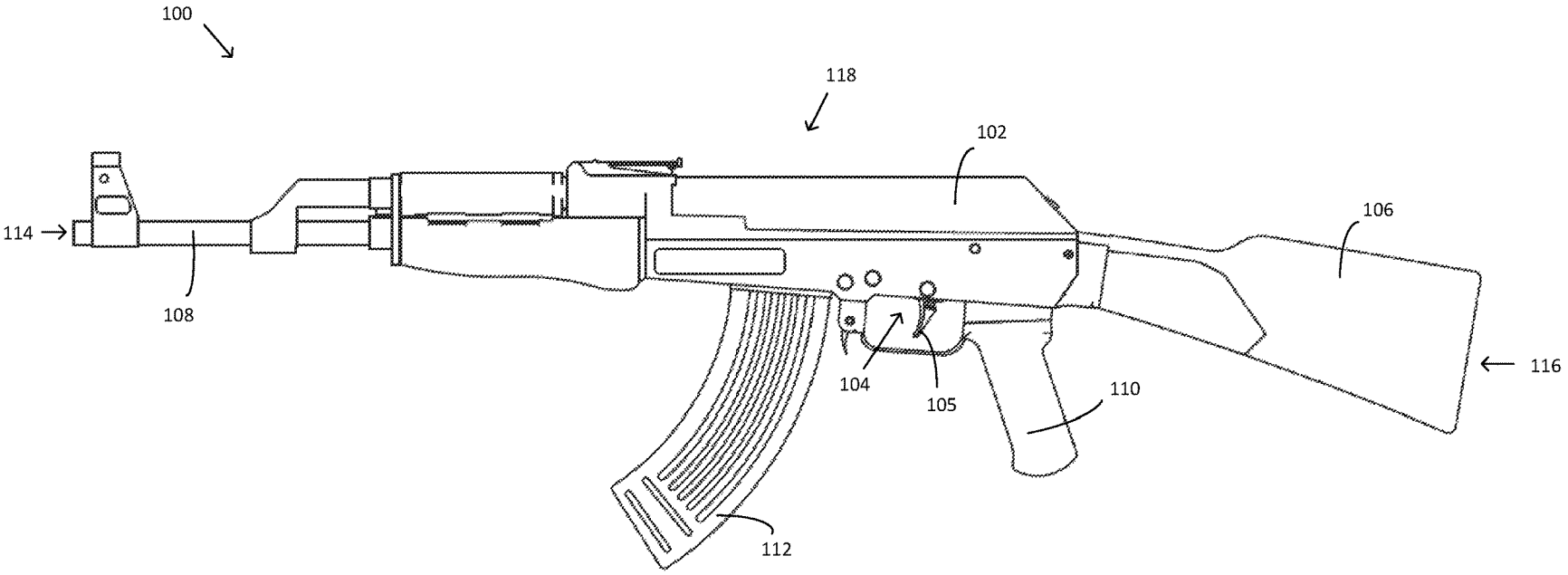
FIG. 1 illustrates a schematic left side view of an example firearm according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 illustrates a schematic left side view of an example firearm 100 according to one embodiment of the present disclosure. In this example, the firearm 100 includes a receiver 102. The receiver includes a trigger mechanism 104, part of which is concealed by the receiver 102 in FIG. 1. The trigger mechanism 104 includes a trigger bow 105. In some embodiments, the firearm 100 may also include a stock 106, a barrel 108, a grip 110 and an ammunition magazine 112.

The firearm 100 is defined by a front 114, a back 116, a top 118 and a bottom 120. Throughout this disclosure, references to orientation (e.g., front(ward), rear(ward), in front, behind, above, below, high, low, back, top, bottom, under, underside, etc.) of structural components shall be defined by that component's positioning in FIG. 1 relative to, as applicable, the front 114, the back 116, the top 118, and the bottom 120 of the firearm 100, regardless of how the firearm 100 may be held and regardless of how that component may be situated on its own (i.e., separated from the firearm 100). In some examples, the firearm 100 is configured to have a plurality of operating modes.

Examples of operating modes include a normal mode and a safe mode. When the firearm 100 is in the safe mode, the firearm is prevented from discharging a round of ammunition. When the firearm 100 is in the normal mode, the firearm 100 is discharged each time that the trigger mechanism 104 is activated ("pulled") without manually reloading ammunition. In some examples, the firearm 100 may also have a rapid fire mode. Like in normal mode, when the firearm 100 is in the rapid fire mode, the firearm 100 is discharged each time that the trigger mechanism 104 is activated without the need for the manual reloading of ammunition. However, in rapid fire mode, the firearm 100 is configured to be discharged at a faster rate than when the firearm 100 is in normal mode.

The firearm 100 can be of a variety of types. Examples of a firearm include handguns, rifles, shotguns, carbines, and personal defense weapons. In at least one embodiment, the firearm is implemented in the AK-47 rifle or a variant of the AK-47.

The receiver 102 is configured to house a firing mechanism and associated components as found in, for example, assault rifles and their variants. The firing mechanism includes a trigger mechanism 104, which is described and illustrated in more detail with reference to FIGS. 2-13.

The trigger mechanism 104 includes a trigger bow 105 configured to be pulled by the finger of the shooter (e.g., the index finger) to initiate the firing cycle sequence of the firearm 100. The trigger mechanism 104 is mounted to the receiver 102. The trigger mechanism 104 is configured to discharge the firearm 100 when a predetermined amount of force is applied to the trigger bow 105. The trigger mechanism 104 can be designed to replace the OEM trigger mechanism of the firearm 100, such as assault type rifles, and provide multiple shooting modes, or can be designed as an OEM trigger mechanism. The trigger mechanism 104 is installed in the receiver 102.

The stock 106 is configured to be positioned at the rear 116 of the firearm 100. The stock 106 provides an additional surface for a shooter to support the firearm 100, preferably against the shooter's shoulder. In some embodiments, the stock 106 includes a mount for a sling. In other embodiments the stock 106 is a telescoping stock. In other embodiments still, the stock 106 is foldable. In some embodiments, the stock 106 is removably mounted to the receiver 102. In at least one embodiment, the stock 106 is threaded to the receiver 102. In other embodiments, the stock 106 is secured to the receiver 102 by one or more fasteners.

The barrel 108 is positioned at the front 114 of the firearm 100 and is configured to be installed to the receiver 102. The barrel 108 provides a path to release an explosion gas and propel a projectile therethrough. In some embodiments, the barrel 108 includes an accompanying assembly that includes one or more of a rail system for mounting accessories (e.g., a fore-grip, a flashlight, a laser, optic equipment), a gas block, and a gas tube.

The grip 110 provides a point of support for the shooter of the firearm and can be held by the shooter's hand, including when operating the trigger mechanism 104. The grip 110 assists the shooter in stabilizing the firearm 100 during firing and manipulation of the firearm 100. In some embodiments, the grip 110 is mounted to the receiver 102.

The magazine 112 is an ammunition storage and feeding device within the firearm 100. In at least one embodiment, the magazine 112 is detachably installed to the firearm 100. For example, the magazine 112 is removably inserted into a magazine well of the receiver 102 of the firearm 100.

Figure 2:
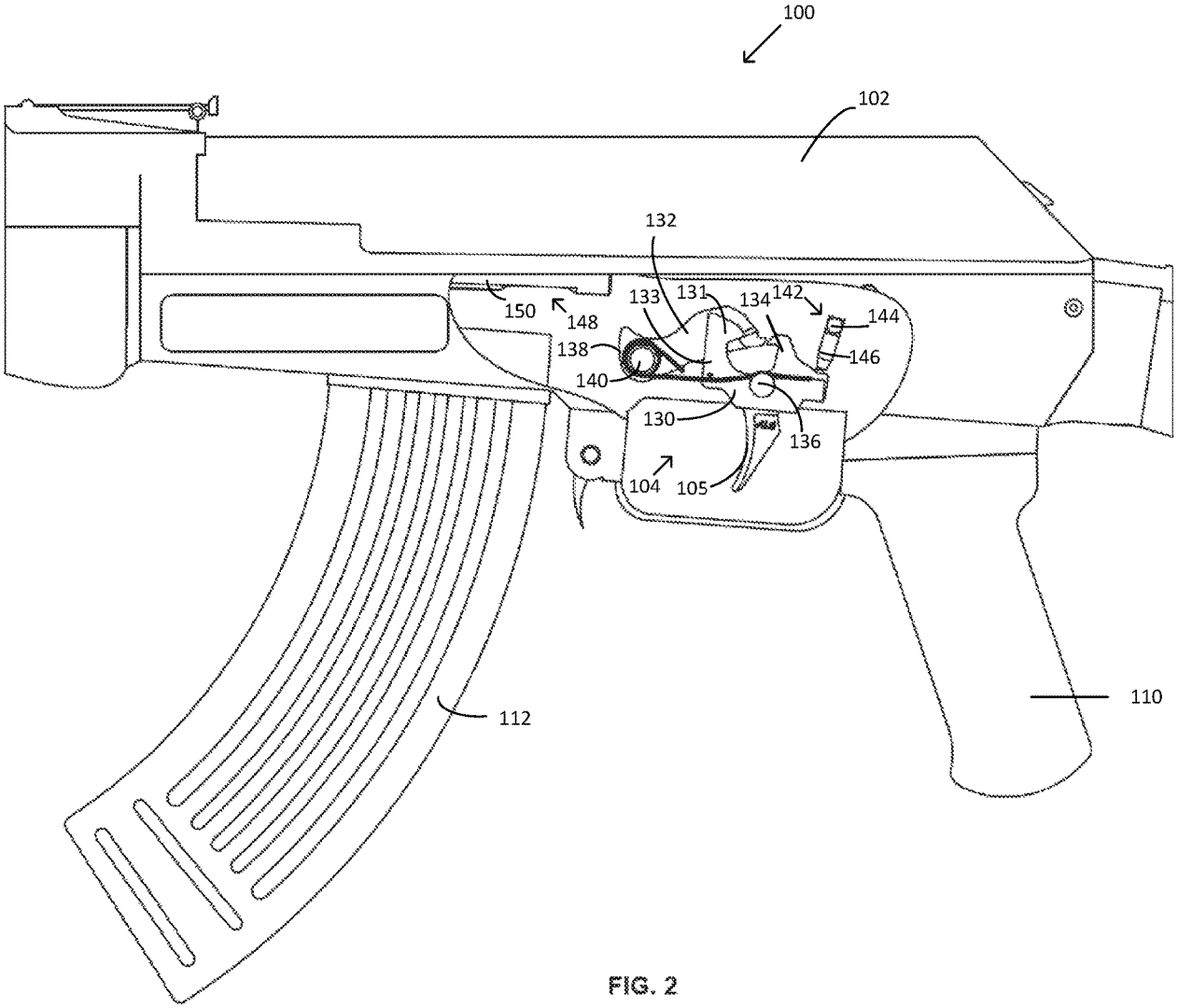
FIG. 2 illustrates a schematic partial left side view of the example firearm of FIG. 1, including a partial cut-away of the firearm receiver.

FIG. 2 illustrates a schematic partial left side view of the example firearm 100 of FIG. 1, including a partial cut-away of the firearm receiver 102.

As shown in FIG. 2, the firearm 100 includes the receiver 102, the trigger mechanism 104, the trigger bow 105, the grip 110 and the ammunition magazine 112 as described above. In addition, in this example the trigger mechanism 104 includes a trigger element 130 having a trigger sear 131 and a sear arm 133, a hammer 132, a disconnector 134, a trigger axle pin 136, a hammer spring 138, a hammer axle pin 140, a safety mechanism 142, a safety axle pin 144, and a safety mechanism lever 146. The firearm 100 also includes a bolt assembly 148 including a bolt 150.

The trigger element 130 is mounted to the interior of the receiver 102 with the trigger axle pin 136. The trigger axle pin 136 extends through the trigger element 130 and the disconnector 134. The trigger element 130 and the disconnector 134 pivot about the trigger axle pin 136 during each firing cycle of the firearm 100.

The hammer 132 is mounted to the interior of the receiver 102 with the hammer axle pin 140. The hammer 132 pivots about the hammer axle pin 140 during each firing cycle of the firearm 100. The hammer spring 138 engages a spool extending from the hammer 132 and at an opposing end the hammer spring 138 engages the trigger element 130.

The trigger sear 131 extends from the sear arm 133. The trigger sear 131 is configured to engage the hammer 132.

The trigger mechanism 104 shown in FIG. 2 is in a primed (i.e., ready for firing) position, in that the hammer 132 engages the trigger sear 131 of the trigger element 130. In the primed position, the hammer spring 138 is biased toward rotating the hammer 132 about the hammer axle pin 140 forward (counterclockwise in FIG. 2). Pulling backward on the trigger bow 105, which is integral with the trigger element 130, causes the trigger element 130 and the disconnector 134 to rotate forward (counterclockwise in FIG. 2). Sufficient forward rotation of the trigger element 130 disengages the hammer 132 from the trigger sear 131, releasing the hammer 132 to rotate forward under the force provided by the hammer spring 138. In the depicted embodiment, the bolt assembly 148 is slidably disposed in the receiver 102 for axially reciprocating recoil movement therein during the firing cycle sequence of the firearm 100. As the hammer rotates forward, the hammer 132 strikes a firing pin carried by the bolt 150, which in turn is thrust forward to contact and discharge a cartridge loaded in a chamber.

After the round has been fired, the bolt 150 reciprocates and is thrust rearwards due to the reaction force from the expanding gases created from firing the round. In addition or alternatively, the bolt 150 may be thrust rearwards manually by the shooter of the firearm 100 (e.g., by utilizing a charging handle). In being thrust rearwards, the bolt 150 contacts the hammer 132, causing it to rotate rearwards (clockwise in FIG. 2) about the hammer axle pin 140. As the hammer 132 rotates rearwards, the trigger bow 105 is still in the fired (i.e., rearward most) position, such that the hammer 132 engages the disconnector 134. As the shooter's rearward finger pressure on the trigger bow decreases, the trigger element 130 and the disconnector 134, under the biasing force of the hammer spring 138, rotate rearwards (clockwise in FIG. 2) about the trigger axle pin 136, causing the hammer 132 to disengage from the disconnector 134 and causing the hammer to reengage the trigger sear 131 of the trigger element 130. Reengagement of the trigger sear 131 by the hammer 132 resets the trigger mechanism 104 such that it is ready for firing again. Thus, the disconnector 134 captures the hammer 132 as it rotates rearwards while the trigger bow is in the rearward most position, preventing the hammer 132 from missing a reset on the trigger sear 131 as it rotates forwards again under the force of the hammer spring 138.

As just described, the hammer 132 disengages the disconnector 134 and rotates forward in response to the hammer spring 138's biasing force. This forward rotation causes the hammer to reengage the trigger sear 131 with a force $F_1$. The $F_1$ force is referred to as "reset trigger slap" that is felt on the trigger bow 105 by the finger of the user and can be uncomfortable or painful, and can cause the trigger sear 131 (FIG. 4) and the hammer sear 180 (FIG. 5) to become disengaged at the moment of hammer handoff to the trigger sear 131. The magnitude of $F_1$ is proportional to the amount of rotation undergone by the hammer 132 between the time $t_1$ that the hammer leaves the disconnector 134, and the time $t_2$ that the hammer 132 reengages the trigger sear 131. Similarly, the magnitude of $F_1$ is proportional to the distance travelled by the hammer from disengagement of the disconnector 134 to reengagement of the trigger sear 131. This is due to the fact that the hammer 132 accelerates in the forward direction on the bias of the hammer spring 138. Thus the greater the time $\Delta t$ between $t_2$ and $t_1$ (and the greater the distance travelled by the hammer 132) the greater the velocity of the hammer 132 when it strikes the trigger sear 131, resulting in a greater reset trigger slap force $F_1$ on the trigger element 130 and the trigger bow 105.

The safety mechanism 142 is configured to facilitate the switching of the firearm 100 between different operating modes. As mentioned above, each operating mode alters the behavior of the firearm 100. In at least one embodiment, the safety mechanism 142 includes a safety mechanism lever 146 that is switchable between a plurality of positions, e.g., a normal mode position and a safe mode position. Switching the safety mechanism lever 146 between different modes is accomplished by rotating the safety mechanism lever 146 about the safety axle pin 144. The safety mechanism 142 is in communication with the trigger mechanism 104. Further, the safety mechanism 142 is disposed in the side of the receiver 102. In some examples a safety handle (FIGS. 11-12) disposed on the outside of the receiver 102 allows the user to adjust the position of the safety mechanism lever 146.

Figure 3:
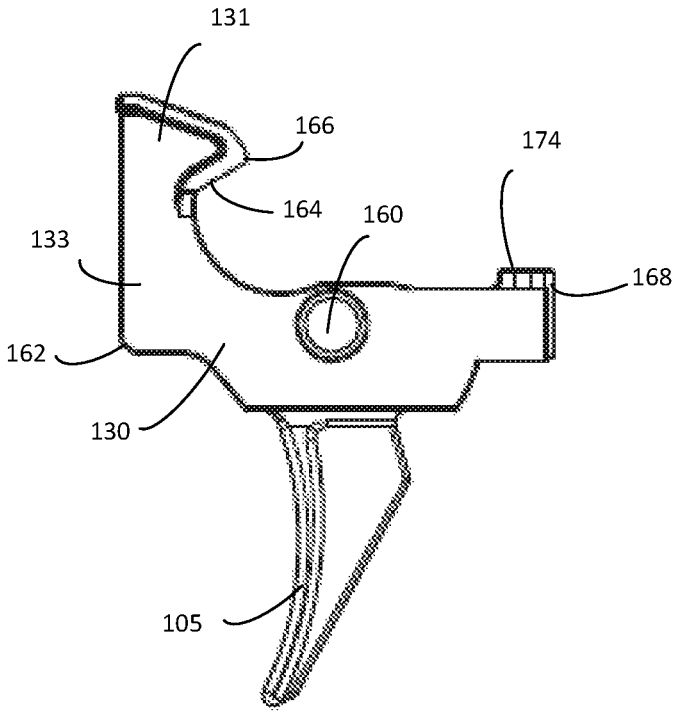
FIG. 3 is a left side view of the example trigger element and trigger bow of FIG. 2.
Figure 4:
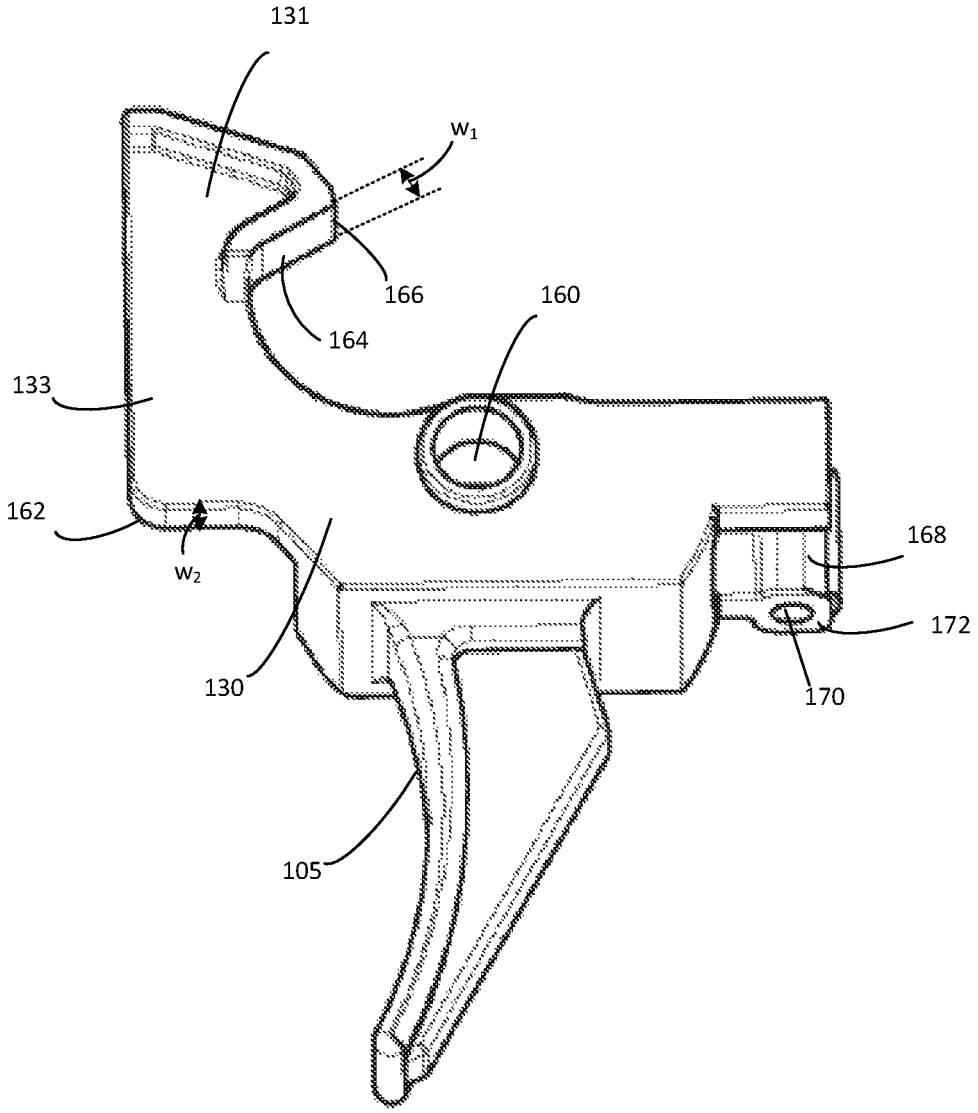
FIG. 4 is a bottom, left side perspective view of the trigger element and trigger bow of FIG. 3.

FIG. 3 is a left side view of the example trigger element 130 and the trigger bow 105 of FIG. 2; FIG. 4 is a bottom, left side perspective view of the trigger element 130 and the trigger bow 105 of FIG. 3. With reference to FIGS. 3-4, the trigger element 130 includes the trigger sear 131 and the sear arm 133 as discussed above. In addition in this example, the trigger element 130 includes a trigger axle pin hole 160, a receiver interface 162, a hammer engagement surface 164, a hammer engagement edge 166, and a safety adjustor housing 168 having a cavity 170 and a wall 172. The safety adjustor housing 168 includes a top 174.

The trigger axle pin hole 160 houses the trigger axle pin 136 (FIG. 2) and allows for pivoting motion of the trigger element 130 about the trigger axle pin 136 (FIG. 2). When the trigger bow 105 is pulled rearwards, the trigger element 130 rotates forwards (counterclockwise about the trigger axle pin 136 (FIG. 2)) until the receiver interface 162 contacts an inner bottom surface of the receiver 102 (FIG. 2). Thus, the positioning of the receiver interface 162 dictates the degree to which the trigger element 130 rotates forwards, thereby determining the length of the trigger pull. In some embodiments, the receiver interface 162 is adjustable, thereby allowing the user to adjust the length of the trigger pull. In some examples, the receiver interface 162 is adjusted by casting or machining the receiver interface 162 to the desired disposition and configuration.

When the trigger element 130 is in the primed position (i.e., ready to shoot) the hammer 132 (FIG. 2) engages the hammer engagement surface 164. Pulling the trigger rotates the trigger element 130 forward, releasing the hammer 132 (FIG. 2) from the hammer engagement surface 164, causing the hammer 132 (FIG. 2) to rotate forward towards the bolt assembly 148 (FIG. 2).

The hammer engagement edge 166 is disposed at the rear of the hammer engagement surface 164. In some examples, the hammer engagement edge 166 is the last contact the hammer makes with the trigger sear 131 before being released during a trigger pull. In some examples the trigger sear 131 is shaped such that the hammer engagement edge 166 is the rearmost edge of the trigger sear 131 when the bow is in the forward most position. This configuration may reduce the length of the trigger pull required to release the hammer 132 (FIG. 2) from the trigger sear 131. In still further examples the amount of surface interface between the hammer 132 (FIG. 2) and the hammer engagement surface 164 when the trigger bow 105 is in the forward most position is reduced in order to reduce the length of the trigger pull required to release the hammer 132 (FIG. 2) from the trigger sear 131. In some examples the amount of surface interface is determined in conjunction with the positioning of the receiver interface 162 such that receiver interface 162 allows just enough (but not excess) forward rotation of the trigger element 130 sufficient to release the hammer 132 (FIG. 2) from the trigger sear 131. Such configurations provide for the shortest possible trigger pull for a given trigger mechanism 104 (FIG. 2). Shorter trigger pulls may be desirable as they facilitate rapid fire of the firearm 100 (FIG. 1), i.e., repeated pulls of the trigger in rapid succession.

The safety adjustor housing 168 is integral with the trigger element 130. The safety adjustor housing 168 includes a wall 172 surrounding a cavity 170. In some examples the cavity 170 is a bore. When the trigger mechanism 104 (FIG. 2) is installed in the receiver 102 (FIG. 2) of the firearm 100 (FIG. 2), the trigger element 130 is positioned such that the cavity 170 is aligned with the safety mechanism lever 146 (FIG. 2) when the firearm 100 (FIG. 2) is in safe mode. In some examples the safety adjustor housing 168 is configured to house a permanent or removable safety adjustor insert (e.g., a pin) in the cavity 170. In some examples, the insert extends above the top 174 of the safety adjustor housing 168. The insert may be adjusted in height depending on the length of the safety mechanism lever 146 (FIG. 2), to ensure a sufficiently small gap between the insert and the safety mechanism lever 146 (FIG. 2) such that the firearm 100 (FIG. 2) will not fire in safe mode. Minimizing or eliminating the gap between the safety mechanism lever 146 (FIG. 2) and the trigger element 130 in safe mode is important for triggers having shorter trigger pulls, as the safety must activate and stop the trigger element from moving before the trigger releases the hammer 132 (FIG. 2). Similarly, the safety adjustor housing 168 in conjunction with a customized insert (FIG. 12) facilitates use of the trigger mechanism 104 (FIG. 2) having a relatively short trigger pull in a firearm with a safety mechanism 142 (FIG. 2) designed for a relatively long trigger pull, as the safety adjustor housing 168 and/or safety adjustor insert compensate for the gap between the safety mechanism lever 146 (FIG. 2) and the trigger element 130.

As shown in FIG. 4, the hammer engagement surface has a width $w_1$. The receiver interface 162 has a width $w_2$. In some examples $w_1$ is greater than $w_2$. In some examples $w_1$ is in a range from about 4.5 mm to about 5.5 mm and $w_2$ is in a range from about 2.5 mm to about 3.5 mm. In a particular example, $w_1$ is about 5 mm and $w_2$ is about 3 mm. $w_1$ and $w_2$ may also fall outside of these ranges. As described below, in some examples of the trigger mechanism of the present disclosure, the distance the hammer 132 (FIG. 2) needs to slide to disengage from the trigger sear 131 is reduced in order to reduce the length of the trigger pull and decrease sear pressure on the hammer 132. However, this can also increase the chances of unintended firing of the firearm 100 (FIG. 2) (e.g., firing a round without pulling the trigger, or by pulling the trigger with less than a predetermined threshold force to fire the firearm) if there is insufficient static friction between the hammer 132 (FIG. 2) and the trigger sear 131 when the trigger is in the primed position. Increasing the width $w_1$ increases the surface area of contact between the hammer 132 (FIG. 2) and the trigger sear 131, thereby spreading frictional wear out over a larger area and increasing the reliability of the trigger mechanism 104 (FIG. 2).

Figure 5:
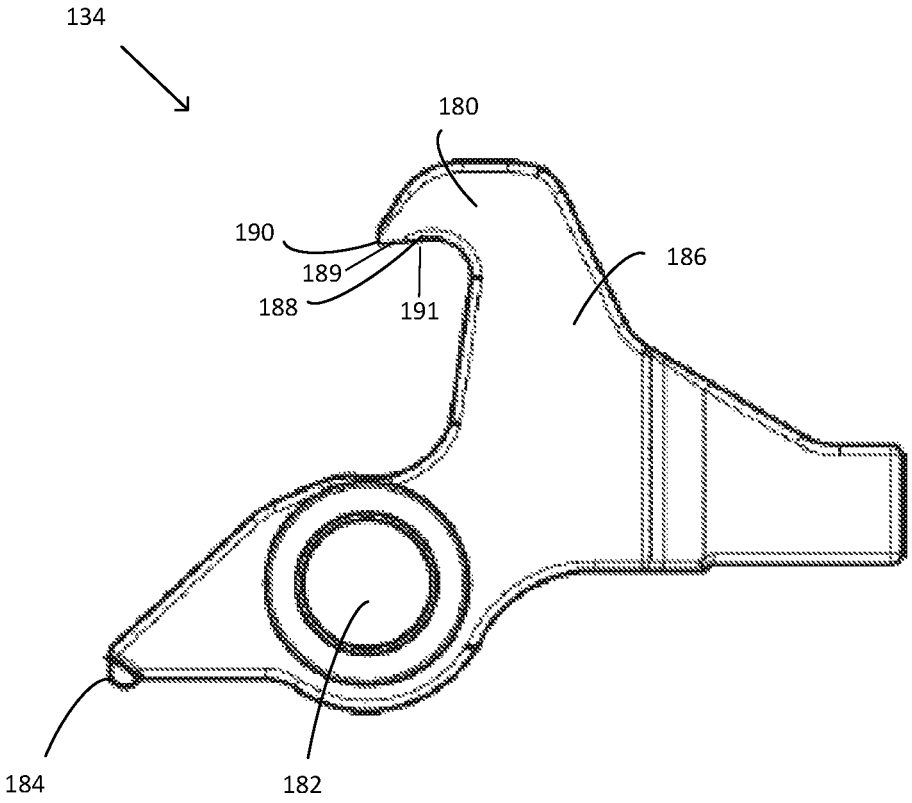
FIG. 5 is a left side view of the example disconnector of FIG. 2.

FIG. 5 is a left side view of the example disconnector 134 of FIG. 2. The disconnector 134 includes a disconnector sear 180, a trigger axle pin hole 182, a forward edge 184 and a disconnector spring housing 186. The disconnector sear 180 includes a hammer engagement surface 188 on the underside 189 of the disconnector sear 180, a hammer engagement edge 190, and a recess 191.

The trigger axle pin hole 182 houses the trigger axle pin 136 (FIG. 2) and allows for pivoting motion of the disconnector 134 about the trigger axle pin 136 (FIG. 2). The disconnector sear 180 engages and holds the hammer 132 (FIG. 2) when the trigger bow 105 (FIG. 2) is in the rearward most position. In some examples, the forward edge 184 of the disconnector 134 is rounded (as shown in FIG. 5). The disconnector spring housing 186 houses a disconnector spring that biases the disconnector 134 to rotate forwards about the trigger axle pin 136 (FIG. 2). This biasing is independent of the force applied to the disconnector 134 by the hammer spring 138 discussed above. Since the disconnector 134 has spring-loaded rearward rotation capability independent from the trigger element 130 (FIG. 2), it can be important, particularly for purposes of repeat or rapid fire, to ensure that the disconnector 134 keeps returning at the end of each trigger cycle to the same position relative to the trigger element 130 (FIG. 2). Machining, casting or otherwise manufacturing the forward edge 184 of the disconnector 134 in a rounded fashion may improve the rapid fire capability of the firearm 100 (FIG. 2) by helping to maintain the spatial relationship between the disconnector 134 and the trigger element 130 at the end of each firing cycle.

The hammer engagement surface 188 extends from the hammer engagement edge 190 and forms the underside 189 of the disconnector sear 180. As shown in FIG. 5, in some examples, the underside 189 as defined by the hammer engagement surface 188 projects away from the hammer engagement edge 190 at an angle such that a partially upward projecting recess 191 is formed underneath the disconnector sear 190. When the hammer 132 (FIG. 2) is being held by the disconnector 134, the hammer 132 (FIG. 2) engages the hammer engagement surface 188. Because the hammer engagement surface 188 defines the recess 191, the hammer engagement surface 188 is effectively farther forward in the receiver 102 (FIG. 2) as compared with a flat or otherwise un-recessed hammer engagement surface on a disconnector sear. Thus, the hammer 132 need not rotate as far rearward (clockwise in FIG. 2) in order to engage the hammer engagement surface 188 as compared with a flat or un-recessed hammer engagement surface on the disconnector sear 134. This results in a shorter distance the hammer 132 (FIG. 2) must travel during a trigger reset from the disconnector sear 180 to the trigger sear 131 (FIG. 2), which in turn reduces reset trigger slap as described above and further below in connection with FIG. 13.

As further shown in FIG. 5, the hammer engagement edge 190 is the forward most edge of the hammer engagement surface 188 when the trigger mechanism 104 (FIG. 2) is mounted in the firearm 100 (FIG. 2).

Figure 6:
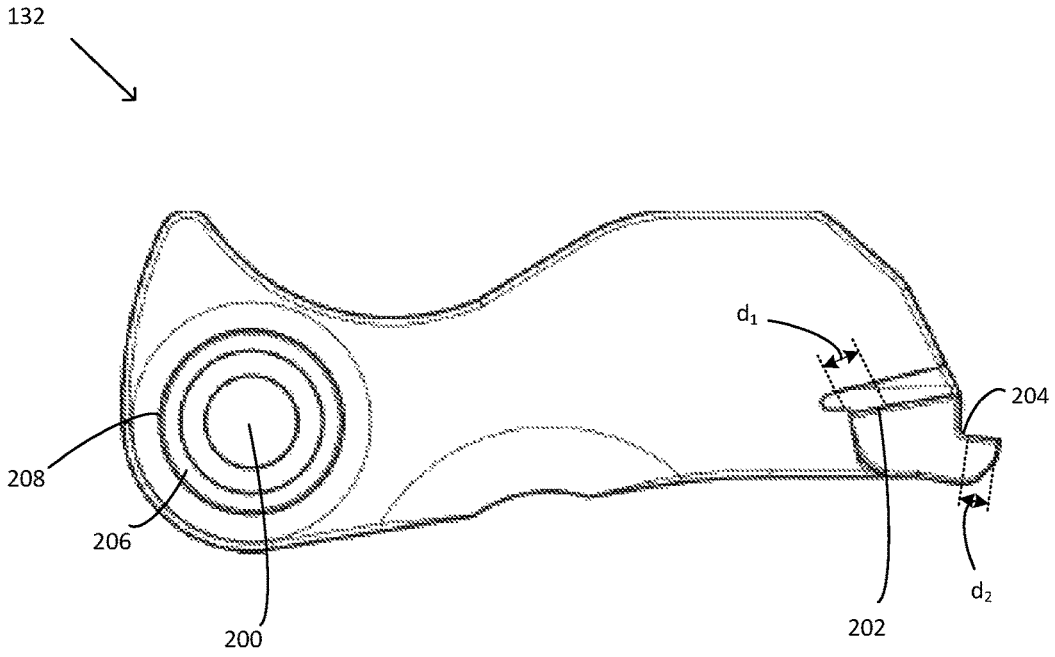
FIG. 6 is a left side view of the example hammer of FIG. 2.

FIG. 6 is a left side view of the example hammer 132 of FIG. 2. The hammer 132 includes a hammer pin hole 200, a trigger sear engagement surface 202, a disconnector sear engagement surface 204, and a hammer spring spool 206 having an outer surface 208.

The hammer pin hole 200 houses the hammer axle pin 140 (FIG. 2), about which the hammer 132 rotates within the receiver 102 (FIG. 2) of the firearm 100 (FIG. 2). The hammer pin hole extends through the hammer spring spool 206.

The trigger sear engagement surface 202 engages the hammer engagement surface 164 (FIG. 4) of the trigger sear 131 (FIG. 4) when the trigger bow 105 (FIG. 2) is in the forward most position (i.e., when the trigger is in a primed position). In some examples a maximum width $d_1$ of the trigger sear engagement surface 202 interfaces with the hammer engagement surface 164 (FIG. 4) when the trigger is primed. In some examples $d_1$ is in a range from about 0.5 mm to about 1.5 mm. In a particular example, $d_1$ is about 1.2 mm. $d_1$ may also fall outside of this range.

The disconnector sear engagement surface 204 engages the hammer engagement surface 188 (FIG. 4) of the disconnector sear 180 (FIG. 4) when the trigger bow 105 (FIG. 2) is in the rearmost position after firing a round (i.e., following reciprocal rearwards movement by the bolt 150 (FIG. 2) immediately prior to a trigger reset). In some examples a maximum width $d_2$ of the disconnector sear engagement surface 204 interfaces with the hammer engagement surface 188 (FIG. 4). In some examples $d_2$ is in a range from about 0.5 mm to about 1.5 mm. In a particular example, $d_2$ is about 1.0 mm. $d_2$ may also fall outside of this range.

Decreasing $d_1$ reduces the trigger pull length required to release the hammer 132 from the trigger sear 131 (FIG. 4) and fire the firearm 100 (FIG. 2) by reducing the distance the trigger sear engagement surface 202 must slide along the hammer engagement surface 164 of the trigger sear 131 (FIG. 4) before release of the hammer 132. In a similar fashion, decreasing $d_2$ reduces the distance the disconnector sear engagement surface 204 must slide along the hammer engagement surface 188 of the disconnector sear 180 (FIG. 5) before release of the hammer 132 while the trigger is resetting, thereby reducing reset trigger slap.

The hammer spring spool 206 surrounds the hammer pin hole 200 and extends out from the page and into the page (FIG. 6) on the left side and right side of the hammer 132. The hammer spring 138 (FIG. 2) is coupled (e.g., coiled around) to the outer surface 208 of the hammer spring spool 206.

Figure 7:
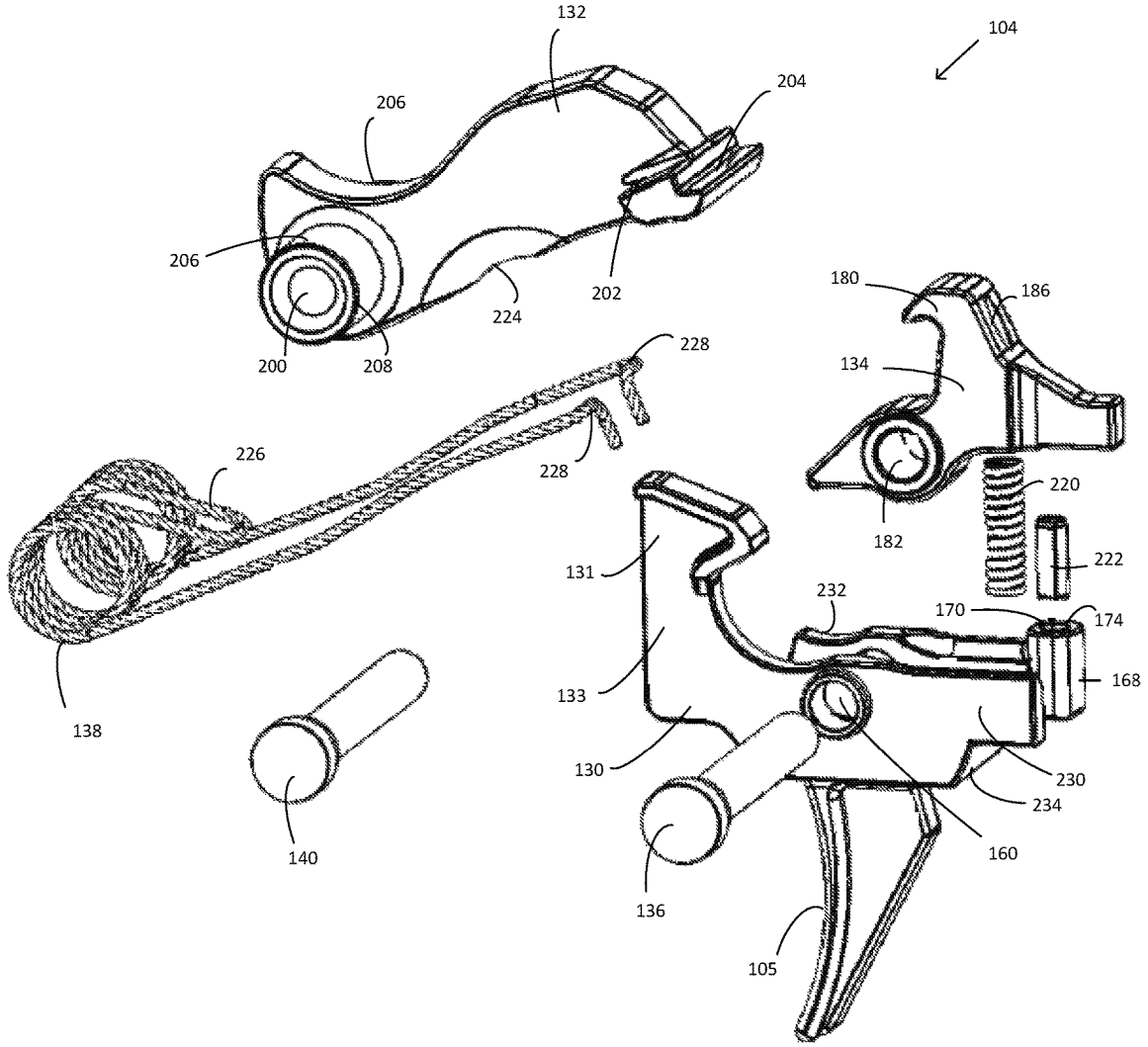
FIG. 7 is an exploded view illustrating example components of the example trigger mechanism of FIG. 2.
Figure 8:
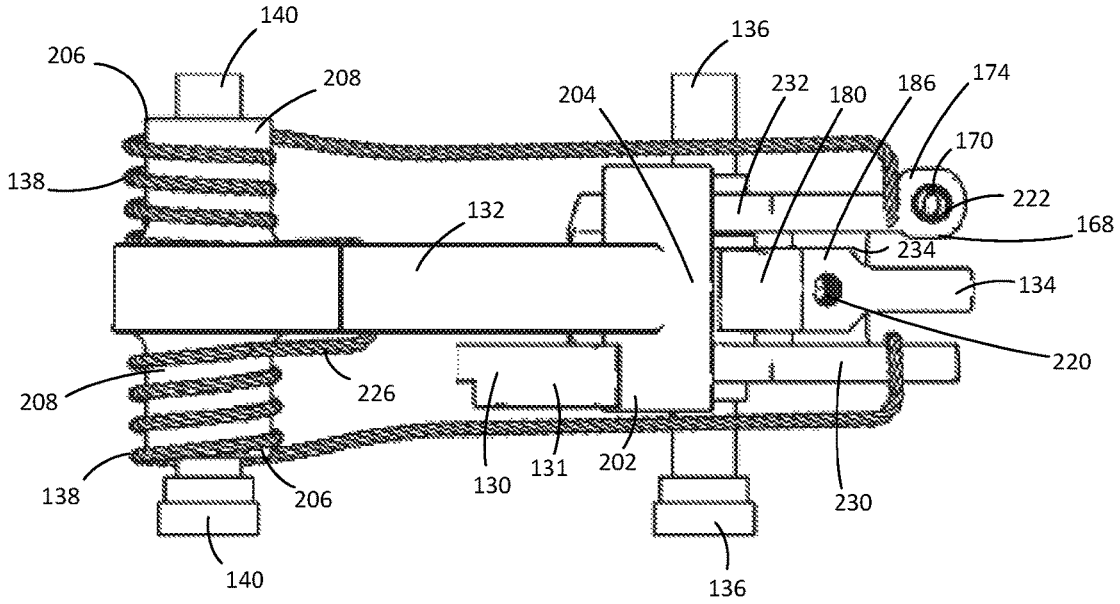
FIG. 8 is a top view of the components of FIG. 7 shown in an example assembled configuration.

FIG. 7 is an exploded view illustrating example components of the example trigger mechanism 104 of FIG. 2; FIG. 8 is a top view of the components of FIG. 7 shown in an example assembled configuration.

With reference to FIGS. 7-8, in this example the trigger mechanism 104 includes the trigger bow 105, the trigger element 130, the trigger sear 131, the sear arm 133, the hammer 132, the disconnector 134, the trigger axle pin 136, the hammer spring 138, the hammer axle pin 140, the trigger axle pin hole 160, the safety adjustor housing 168 having the cavity 170, the wall 172, and the top 174; the disconnector 134 having the disconnector sear 180, the trigger axle pin hole 182, and the disconnector spring housing 186; the hammer 132 including the hammer pin hole 200, the trigger sear engagement surface 202, the disconnector sear engagement surface 204, and the hammer spring spool 206 having the outer surface 208, as described above. In addition, in this example the trigger mechanism 104 includes a disconnector spring 220 and a safety adjustor insert 222; the hammer 132 includes a recess 224; the hammer spring 138 includes a loop extension 226 and trigger element engagement portions 228, and the trigger element 130 includes a first wall 230, a second wall 232, and a base 234.

In this example, the disconnector spring 220 is housed in the disconnector spring housing 186. When the disconnector 134 is rotated rearwards (clockwise), e.g., by the force provided by a reciprocating hammer 132 following the firing of a round of ammunition, the disconnector spring 220 compresses against the base 234 of the trigger element 130. This allows the disconnector sear engagement surface 204 to engage the disconnector sear 180.

The safety adjustor insert 222 is inserted in the cavity 170 of the safety adjustor housing 168. In some examples, the safety adjustor insert 222 is a screw or a pin. In some examples the safety adjustor insert 222 is configured (e.g., by machining, casting, or screwing) such that a portion of the safety adjustor insert 222 lies above the top 174 of the safety adjustor housing 168. The degree to which the safety adjustor insert 222 extends above the top 174 of the safety adjustor housing 168 is determined by the length of the safety mechanism lever 146 (FIG. 2) as discussed above such that when the safety is turned on (i.e., the safety mode is engaged), the safety mechanism lever 146 (FIG. 2) engages the safety adjustor insert 222 preventing rotation of the trigger element 130. In some examples, the safety adjustor insert 222 is replaceable, and may be modified or swapped with another one to accommodate different firearm safeties and/or different trigger mechanisms.

In addition to, or alternative to, the safety adjustor insert 222 and the safety adjustor housing 168, a rear portion of the second wall 232 of the trigger element 130 is cast or machined to protrude upwards from the second wall 232 a pre-determined distance in order to adequately engage the safety mechanism lever 146 (FIG. 2) in safe mode. In some examples, the upwards protruding portion of the rear portion of the second wall 232 consists of a screw configured to mate with a corresponding threaded screw hole in the second wall 232 and/or the receiver 102 (FIG. 2). In these examples, the height of the screw extending above the second wall 232 is adjusted by screwing or unscrewing to the desired level suitable for adequately engaging the safety mechanism lever 146 (FIG. 2) in safe mode.

The hammer spring 138 is looped around the hammer spring spool 206 which extends on both sides of the hammer 132. In addition, in some examples the hammer spring loop extension 226 couples to the recess 224 in the hammer 132 to provide a rotational biasing force to the hammer 132 in the forward (counterclockwise) direction. In some examples, the trigger element engagement portions 228 of the hammer spring 138 couple to the first wall 230 and the second wall 232, respectively, of the trigger element 130. When the trigger bow 105 is pulled rearwards, rotating the trigger element 130 forwards (counterclockwise), the trigger element engagement portions 228 apply a downwards (i.e., toward the base 234) restoring force to the first wall 230 and the second wall 232, causing the trigger element 130 to tend to rotate rearwards (clockwise direction) and thereby causing the trigger bow 105 to reset forwards for firing another round.

In an assembled configuration of the components illustrated in FIG. 7, the disconnector 134 is disposed between the first wall 230 and the second wall 232 of the trigger element 130 such that the trigger axle pin hole 182 of the disconnector 134 is aligned with trigger axle pin hole 160 disposed in each of the first wall 230 and the second wall 232 of the trigger element 130. The trigger axle pin 136 is inserted through the trigger axle pin hole 160 on each of the first wall 230 and the second wall 232 of the trigger element 130, as well as through the trigger axle pin hole 182 of the disconnector 134, allowing the trigger element 130 and the disconnector 134 to rotate forwards (counterclockwise) in tandem upon pulling rearwards on the trigger bow 105.

As shown in FIG. 7, the sear arm 133 is an elongated component that extends substantially upwards from the first wall 230 of the trigger element 130, and the trigger sear 131 extends from the sear arm 133.

Figure 9:
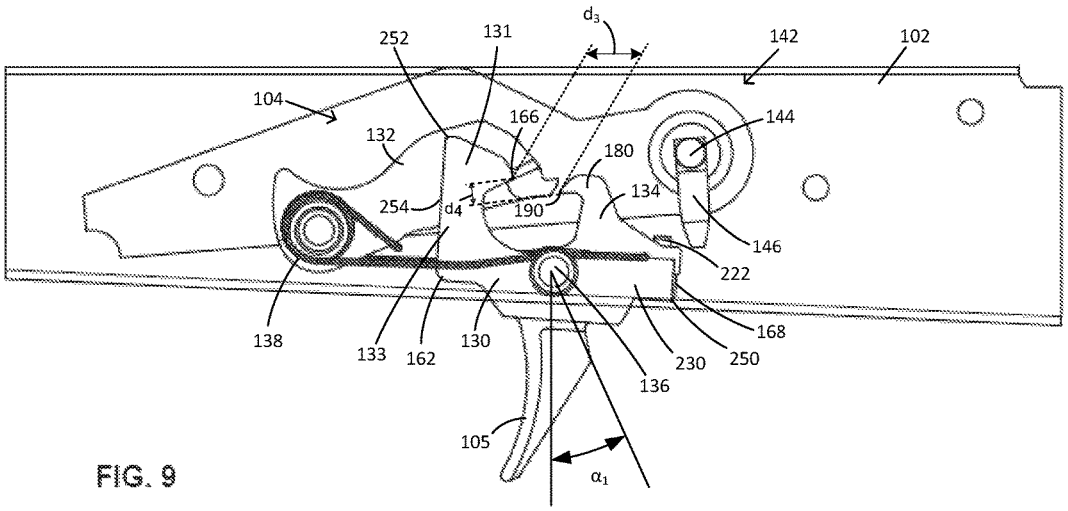
FIG. 9 is a left side view of an assembled trigger mechanism of FIG. 2 mounted to the firearm receiver of FIG. 2, illustrating the trigger bow 105 in the forward most position.
Figure 10:
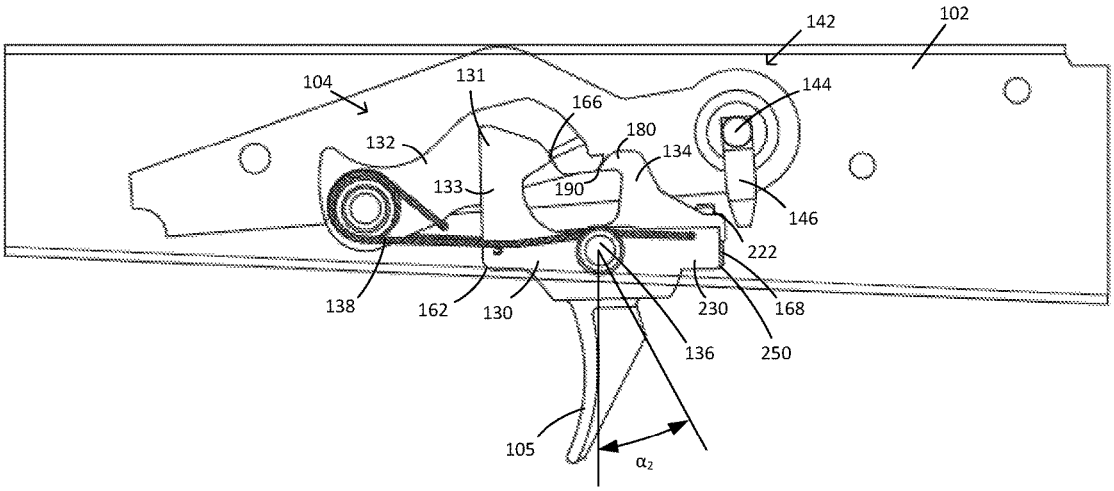
FIG. 10 is a left side view of the assembled trigger mechanism of FIG. 9, illustrating the trigger bow in the rearward most position.

FIG. 9 is a left side view of an assembled trigger mechanism 104 of FIG. 2 mounted to the firearm receiver 102 of FIG. 2, illustrating the trigger bow 105 in the forward most position; FIG. 10 is a left side view of the assembled trigger mechanism 104 of FIG. 9, illustrating the trigger bow 105 in the rearward most position. With reference to FIGS. 9-10, the trigger mechanism 104 includes the trigger bow 105, the trigger element 130, the trigger sear 131, the sear arm 133, the hammer 132, the disconnector 134, the trigger axle pin 136, the hammer spring 138, the safety mechanism 142, the safety axle pin 144, the safety mechanism lever 146, the receiver interface 162, the hammer engagement edge 166 on the trigger sear 131, the safety adjustor housing 168, the disconnector sear 180, the hammer engagement edge 190 on the disconnector sear 180, the safety adjustor insert 222, and the trigger element 130 includes the first wall 230, as discussed above. In addition, in this example, the trigger element 130 includes a rear receiver interface 250, and the trigger sear 131 has a top 252 and a bottom 254.

In FIG. 9, the trigger bow 105 is in the forward most position, and the receiver interface 162 is elevated above the surface of the receiver and does not contact the receiver 102. In FIG. 10, the trigger bow 105 is in the rearward most position, and the receiver interface 162 is in contact with the receiver 102, preventing further forwards (counterclockwise) rotation of the trigger element 130. FIG. 10 depicts a moment in time after a round has been fired and the firearm bolt has reciprocated, rotating the hammer 132 rearwards (clockwise) until it comes in contact with the disconnector 134, immediately prior to compression of the disconnector spring 220 (FIGS. 7-8) and corresponding rearwards (clockwise) rotation of the disconnector 134.

With reference to FIG. 9, when the trigger is in the forward most position, there is a shortest distance $d_3$ between the hammer engagement edge 166 on the trigger sear 131 and the hammer engagement edge 190 on the disconnector sear 180. In some examples $d_3$ is minimized to reduce reset trigger slap. In some examples, $d_3$ is in a range from about 6 mm to about 12 mm. In some examples $d_3$ is in a range from about 6 mm to about 9 mm. In a particular example, $d_3$ is about 8.7 mm. $d_3$ may fall outside of these ranges. Analogous to $d_3$, $d_4$ represents the shortest vertical distance between the hammer engagement edge 166 on the trigger sear 131 and the hammer engagement edge 190 on the disconnector sear 180. As with $d_3$, in some examples $d_4$ is minimized to reduce reset trigger slap. In some examples, $d_4$ is in a range from about 0.5 mm to about 5 mm. In some examples $d_4$ is in a range from about 1 mm to about 4 mm. In a particular example, $d_4$ is about 3 mm. $d_4$ may fall outside of these ranges.

In addition, the trigger sear 131 has a height $h_1$ (FIG. 9), which is the shortest distance between the top 252 and the bottom 254 of the trigger sear 131. In some examples, $h_1$ is in range from about 7 mm to about 9 mm. In a particular example, $h_1$ is about 8.1 mm. $h_1$ may also fall outside of this range. As discussed above, reducing the gap between the hammer engagement edge 190 on the disconnector sear 180 and the hammer engagement edge 166 on the trigger sear 131 reduces reset trigger slap. In some examples, this gap is reduced at least partially by disposing the hammer engagement edge 190 on the disconnector sear 180 such that the hammer engagement edge 190 is as high as at least a portion of the trigger sear 131 when the trigger bow 105 is in the forward most position. In some examples, the hammer engagement edge 190 is disposed such that it is above at least a portion of the trigger sear 131.

In some examples, when the trigger bow 105 is in the forward most position (FIG. 9) the rear receiver interface 250 of the trigger element 130 contacts the receiver 102 preventing further rearward (clockwise) rotation of the trigger element 130, while at the same time preventing further forward movement of the trigger bow 105. In this position (FIG. 9), the position of the trigger bow 105 relative to the receiver 102 can be defined by an angle $\alpha_1$ relative to a vertical line passing through the center of the trigger axle pin 136.

When the trigger bow 105 is in the rearward most position (FIG. 10) the receiver interface 162 of the trigger element 130 contacts the receiver 103, preventing further forward (counterclockwise) rotation of the trigger element 130, while at the same time preventing further rearward movement of the trigger bow 105. In this position (FIG. 10), the position of the trigger bow 105 relative to the receiver 102 can be defined by an angle $\alpha_2$ relative to a vertical line passing through the center of the trigger axle pin 136. The difference in angle, $\alpha_2$-$\alpha_1$, between the forward most position and rearward most position of the trigger bow 105 is an angle $\theta$. In some examples $\theta$ is in a range from about 1° to about 30°. In some examples, $\theta$ is in a range from about 3° to about 15°. In a specific example, $\theta$ is about 5°. The value of $\theta$ may also fall outside of these ranges.

Figure 11:
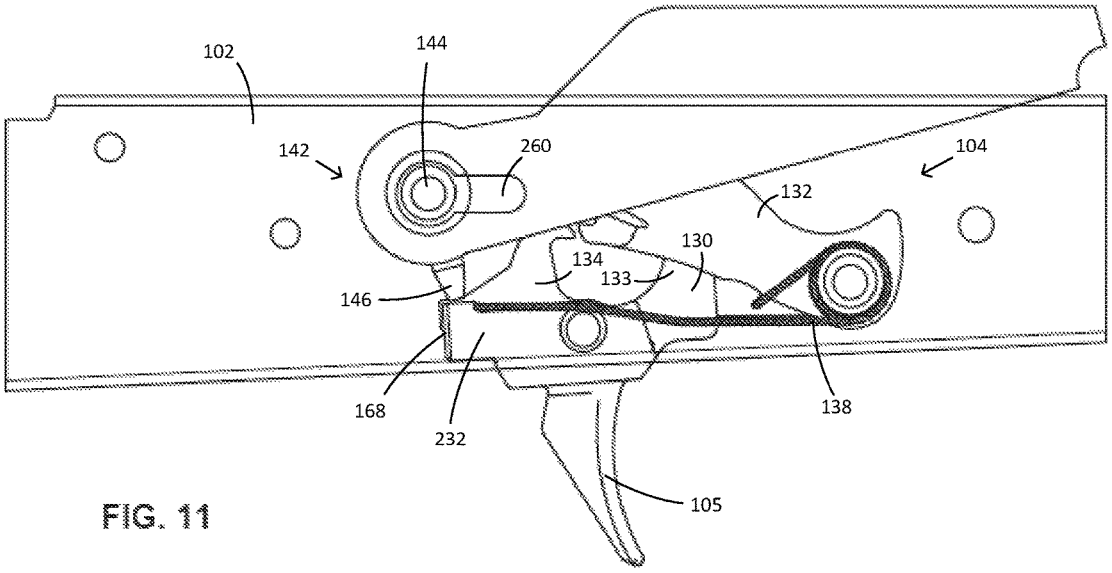
FIG. 11 is a right side view of an assembled trigger mechanism of FIG. 2 mounted to the firearm receiver of FIG. 2 and illustrating the example safety mechanism of FIG. 2.
Figure 12:
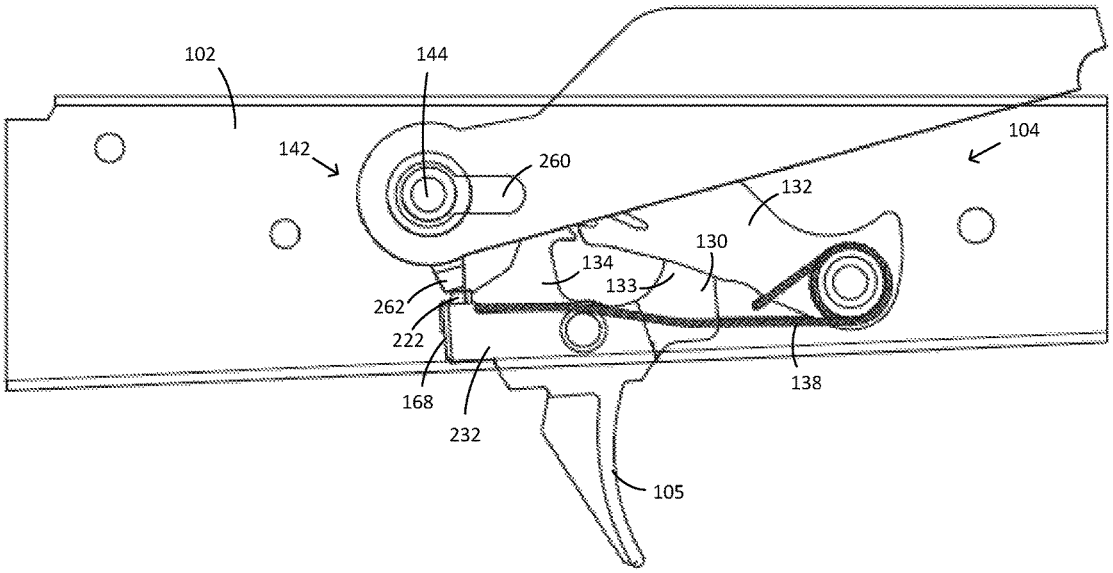
FIG. 12 is a right side view of the assembled trigger mechanism of FIG. 11 but including an alternative embodiment of a safety mechanism.

FIG. 11 is a right side view of an assembled trigger mechanism 104 of FIG. 2 mounted to the firearm receiver 102 of FIG. 2 and illustrating the example safety mechanism 142 of FIG. 2; FIG. 12 is a right side view of the assembled trigger mechanism 104 of FIG. 11 but including an alternative embodiment of a safety mechanism 142.

With reference to FIGS. 11-12, the trigger mechanism 104 includes the trigger bow 105, the trigger element 130, the sear arm 133, the hammer 132, the disconnector 134, the hammer spring 138, the safety mechanism 142, the safety axle pin 144, the safety adjustor housing 168, and the second wall 232 of the trigger element 130, as discussed above. In addition, with reference to FIG. 11, the safety mechanism 142 includes the safety mechanism lever 146 as discussed above, and with reference to FIG. 12, the trigger mechanism 104 also includes the safety adjustor insert 222 as discussed above. With reference to FIGS. 11-12, the safety mechanism 142 also includes a handle 260. With reference to FIG. 12, the safety mechanism 142 also includes an alternative embodiment of a safety mechanism lever 262.

The safety handle 260 is disposed on an outer surface of the receiver 102 and allows the user to manipulate the safety mechanism 142 by rotating the safety mechanism lever (146, 262) between safe mode and normal mode. In both FIGS. 11-12 the trigger mechanism 104 is illustrated in safe mode in that the safety mechanism lever (146, 262) engages the trigger element 130 (FIG. 11) or engages the safety adjustor insert 222 (FIG. 12), thereby preventing forward (clockwise) rotation of the trigger element 130, which in turn prevents the trigger bow 105 from being pulled.

The example trigger mechanism 104 in FIG. 11 does not require a safety adjustor insert 222 (FIG. 12) or upwards extending protrusion to bridge a gap between the safety mechanism lever 146 and the trigger element 130. The example trigger mechanism 104 in FIG. 12 does require a safety adjustor insert 222 (or, alternatively, an upwards extending protrusion as discussed above) to bridge the gap (in safe mode) between the safety mechanism lever 262 and the trigger element 130. Alternatively, a safety adjustor insert may be included in the example trigger mechanism 104 of FIG. 11 but has been ground down or otherwise shortend to the same height as the safety adjustor housing 168. The safety adjustor insert 222 is inserted in the safety adjustor housing 168, and the degree to which the safety adjustor insert 222 extends above the safety adjustor housing 168 is customizable for each safety mechanism lever (146, 262), as discussed above.

Figure 13:
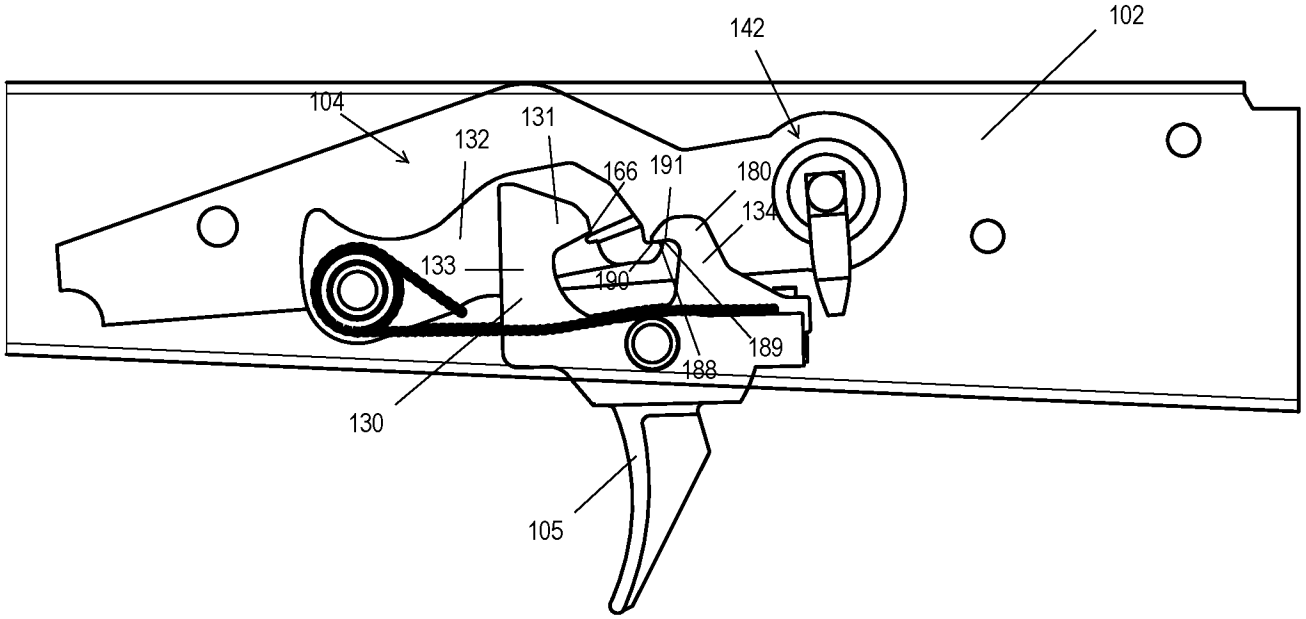
FIG. 13 is a left side view of the assembled trigger mechanism and receiver of FIG. 9, illustrating the trigger bow in the rearward most position and the hammer engaging the disconnector.

FIG. 13 is a left side view of the assembled trigger mechanism 104 and receiver 102 of FIG. 9, illustrating the trigger bow 105 in the rearward most position and the hammer 132 engaging the disconnector 134. With reference to FIG. 13, the trigger mechanism 104 includes the trigger bow 105, the trigger element 130, the trigger sear 131, the sear arm 133, the hammer 132, the disconnector 134, the safety mechanism 142, the hammer engagement edge 166 on the trigger sear 131, and the disconnector sear 180 having the hammer engagement surface 188, the underside 189, the hammer engagement edge 190, and the partially upward projecting recess 191, as discussed above.

FIG. 13 illustrates a moment in time after a round has been fired and the firearm bolt has reciprocated, causing: rotation of the hammer 132 rearwards (clockwise) until it comes in contact with the disconnector 134; subsequent compression of the disconnector spring 220 (FIGS. 7-8) by the hammer 132 (and corresponding rearwards (clockwise) rotation of the disconnector 134); and subsequent decompression of the disconnector spring 220 (FIGS. 7-8) (and corresponding forwards (counterclockwise) rotation of the disconnector 134), but before the trigger bow 105 moves forward to hand off the hammer 132 from the disconnector sear 180 to the trigger sear 131.

As shown in FIG. 13, the hammer 132 engages the disconnector sear 180 by positioning itself up in the recess 191. This nesting of the hammer 132 up in the recess 191 effectively increases the height of the hammer 132 within the receiver 102 relative to the hammer engagement edge 166 on the trigger sear 131, and reduces the distance the hammer must travel during a handoff from the disconnector sear 180 to the trigger sear 131 when the trigger bow 105 moves forward to fire another round of ammunition (i.e during a trigger reset). The shorter distance the hammer 132 must travel during a trigger reset from the disconnector sear 180 to the trigger sear 131 in turn can reduce reset trigger slap as described above.

Figure 14:
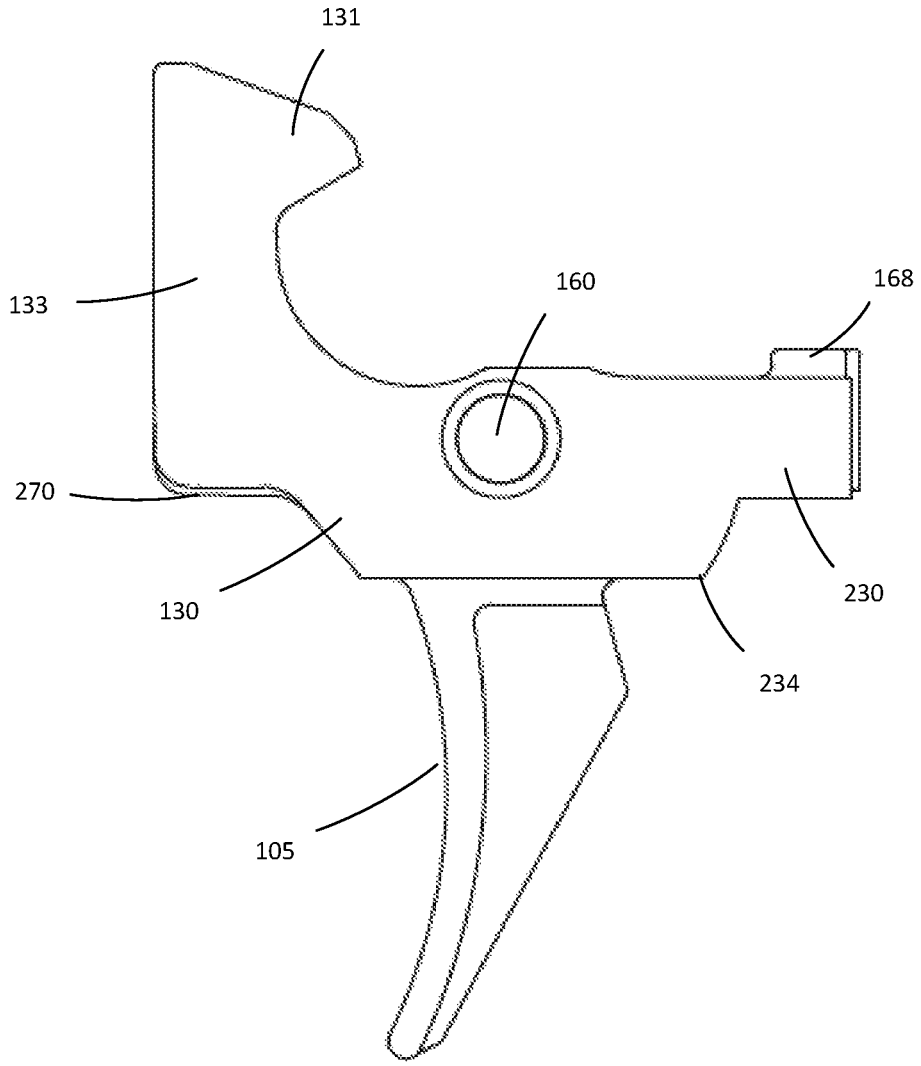
FIG. 14 is a left side view of the trigger element and the trigger bow of FIG. 2, illustrating an alternative embodiment of a receiver interface.

FIG. 14 is a left side view of the trigger element 130 of FIG. 2 and the trigger bow 105 of FIG. 2, illustrating an alternative embodiment of a receiver interface. The trigger element 130 includes the trigger sear 131, the sear arm 133, the trigger axle pin hole 160, the safety adjustor housing 168, the first wall 230 and the base 234 as discussed above. In addition, in this example the trigger element 130 includes a modified receiver interface 270.

The modified receiver interface 270 can be machined or cast. The modified receiver interface 270 may be employed to increase or decrease the length of the trigger pull. In the example shown in FIG. 14, the modified receiver interface 270 is augmented as compared with the receiver interface 162 of the trigger element 130 shown in, e.g., FIG. 9, thereby reducing the length of the trigger pull as discussed above.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A trigger mechanism for a firearm receiver, the trigger mechanism comprising:

a bow having a forward most position and a rearward most position in the firearm receiver;

a hammer;

a trigger element comprising a receiver interface, a sear arm, a trigger sear extending from the sear arm, and a hammer engagement edge; and a disconnector comprising a disconnector sear; a second hammer engagement edge; and a hammer engagement surface, wherein: the trigger element hammer engagement edge is a first hammer engagement edge; the first hammer engagement edge faces an axis of rotation of the trigger element; the second hammer engagement edge is as high as at least a portion of the trigger sear when the bow is in the forward most position; and the hammer engagement surface extends from the second hammer engagement edge toward a top of the disconnector sear and is curved so as to define a recess within the disconnector sear.

2. The trigger mechanism of claim 1, wherein the second hammer engagement edge is above at least a portion of the trigger sear when the bow is in the forward most position.

3. The trigger mechanism of claim 1, wherein a shortest vertical distance between the first hammer engagement edge and the second hammer engagement edge is in a range from about 0.5 mm to about 5 mm.

4. The trigger mechanism of claim 1, wherein a shortest vertical distance between the first hammer engagement edge and the second hammer engagement edge does not exceed 3 mm.

5. The trigger mechanism of claim 1, wherein the disconnector comprises a rounded forward edge.

6. The trigger mechanism of claim 1, wherein the hammer engagement surface extends from the second hammer engagement edge to form an underside of the disconnector sear.

7. The trigger mechanism of claim 1, wherein the second hammer engagement edge is a forward most edge of the hammer engagement surface when the disconnector is mounted in the firearm receiver.

8. The trigger mechanism of claim 1, wherein the trigger element further comprises a modified receiver interface.

9. The trigger mechanism of claim 1, wherein the hammer comprises a recess defined on an underneath side of the hammer, wherein the recess is configured to receive a hammer spring.

10. The trigger mechanism of claim 1, wherein the trigger element comprises a first wall spaced apart from a second wall.

11. The trigger mechanism of claim 10, wherein the sear arm extends from at least one of the first wall and the second wall.

12. The trigger mechanism of claim 11, wherein the sear arm extends from only the first wall.

13. The trigger mechanism of claim 10, wherein the receiver interface is defined in at least one of the first wall and the second wall.

14. The trigger mechanism of claim 13, wherein the receiver interface is defined in only the first wall.

15. The trigger mechanism of claim 10, wherein the sear arm extends from the first wall and the receiver interface is defined in the first wall.

16. The trigger mechanism of claim 10, wherein a base extends between the first wall and the second wall, and the bow extends from the base.

17. A firearm comprising the trigger mechanism of claim 1.

18. A trigger mechanism for a firearm receiver, the trigger mechanism comprising:

a bow having a forward most position and a rearward most position in the firearm receiver;

a hammer;

a trigger element comprising a receiver interface, a sear arm, a trigger sear extending from the sear arm, and a first hammer engagement edge; and a disconnector comprising a disconnector sear; a second hammer engagement edge; and a hammer engagement surface, wherein the hammer engagement surface extends from the second hammer engagement edge toward a top of the disconnector sear and is curved so as to define a recess within the disconnector sear.

* * * * *